United States Patent [19]

Collier et al.

[11] Patent Number: 5,009,954

[45] Date of Patent: Apr. 23, 1991

[54] SHEATH CORE FIBER AND ITS METHOD OF MANUFACTURE

[75] Inventors: John R. Collier; Billie J. Collier, both of Athens, Ohio

[73] Assignee: Ohio University, Athens, Ohio

[21] Appl. No.: 506,495

[22] Filed: Apr. 4, 1990

Related U.S. Application Data

[63] Continuation of Ser. No. 161,293, Feb. 29, 1988, abandoned, which is a continuation-in-part of Ser. No. 754,327, Jul. 12, 1985, abandoned.

[51] Int. Cl.[5] ..... D02G 3/00

[52] U.S. Cl. ..... 428/400; 428/373; 428/374; 428/392; 428/393; 428/394; 428/395; 428/375

[58] Field of Search ..... 428/373, 374, 375, 392, 428/393, 394, 395, 400

[56] References Cited

U.S. PATENT DOCUMENTS

| | | | |
|---|---|---|---|
| 2,063,180 | 12/1936 | Meyer et al. | 18/8 |
| 2,193,818 | 3/1940 | Kajita et al. | 427/338 |
| 2,312,469 | 3/1943 | Freund | 428/395 |
| 2,317,728 | 4/1943 | Bristol | 427/414 X |
| 2,433,711 | 6/1948 | Sisson | 18/54 |
| 2,439,813 | 4/1948 | Kulp et al. | 28/82 |
| 2,439,815 | 4/1948 | Sisson | 28/82 |
| 2,838,455 | 6/1958 | Tompkins | 428/393 X |
| 2,932,079 | 4/1960 | Dietzsch | 28/82 |
| 2,989,798 | 6/1961 | Bannerman | 428/373 |
| 3,244,785 | 4/1966 | Hollandsworth et al. | 264/171 |
| 3,259,537 | 7/1966 | Battista | 428/393 |
| 3,458,615 | 7/1969 | Bragaw, Jr. et al. | 264/171 |
| 3,499,810 | 3/1970 | Wagle | 428/359 X |
| 3,541,198 | 11/1970 | Ueda et al. | 264/171 |
| 3,579,414 | 5/1971 | Ueda et al. | 161/173 |
| 3,593,513 | 7/1971 | Reese | 57/140 |
| 3,616,183 | 10/1971 | Brayford et al. | 161/175 |
| 3,658,634 | 4/1972 | Yanagi et al. | 161/175 |
| 3,671,620 | 6/1972 | Inoue | 264/171 |
| 3,679,541 | 7/1972 | Davis et al. | 161/175 |
| 3,725,192 | 4/1973 | Ando et al. | 161/175 |
| 3,760,046 | 9/1973 | Schwartz et al. | 264/47 |
| 3,785,918 | 1/1974 | Kawai et al. | 428/393 X |
| 3,886,015 | 5/1975 | Turner | 156/166 |
| 4,059,949 | 11/1977 | Lee | 57/140 BY |
| 4,075,378 | 2/1978 | Anton et al. | 428/97 |
| 4,309,476 | 2/1978 | Nakamura et al. | 428/374 |
| 4,382,111 | 5/1983 | Kawayama et al. | 428/395 X |

*Primary Examiner*—Lorraine T. Kendell
*Attorney, Agent, or Firm*—John L. Gray

[57] ABSTRACT

A sheath core fiber having an inner continuous core made from an oriented thermoplastic material, such as polyester, nylon, acrylic, and olefin completely surrounded by an adherent continuous sheath which is not readily removable from said core, is retained on said core during ultimate usage of said fiber, and is made of a nonthermoplastic material, such as regenerated cellulose and protein. The fiber maintains the crease and tear resistance of the core material, yet has the water sorptivity and dyeability of the sheath material.

A method of manufacturing such a fiber is also disclosed.

5 Claims, 2 Drawing Sheets

SHEATH CORE FIBER AND ITS METHOD OF MANUFACTURE

This application is a continuation of application Ser. No. 161,293, filed Feb. 28, 1988, now abandoned, which in turn is a continuation-in-part of application Ser. No. 754,327, filed July 12, 1985, now abandoned.

BACKGROUND OF THE INVENTION

The desirability of combining the optimum characteristics of oriented thermoplastic materials, such as maintenance of crease and tear resistance, with the dyeability and sorptivity of natural materials has been recognized for some time. Attempts in this direction have usually resulted in blending the two materials together so that there is an averaging of the properties of the materials rather than an optimization of each of the component's most desirable properties.

Coextrusion of two different materials to form a side-by-side bicomponent fiber has been done extensively, primarily to develop a crimped product. For example, U.S. Pat. No. 2,439,813, Kulp, discloses such a product, where both components are viscose of different contractivity due to different aging times and different concentrations of cellulose, carbon disulfide, or sodium hydroxide. Sheath core structures have also been formed, again usually for crimping purposes. For example, U.S. Pat. No. 3,458,615, Bragaw, discloses a coextrusion of two streams in the molten state and any orientation to be developed will be induced downstream from the die. The Bragaw patent is directed to the production of light guides where a well controlled smooth interface is critical to maintaining internal reflection of the light passing through the core and reflected off the surface. U.S. Pat. No. 2,932,079, Dietzsch, discloses a sheath core structure which must contain at least two cores of different materials and a sheath of a third material. This is so that crimp may be developed by differential thermal contraction of nonconcentric core and sheath layers. U.S. Pat. No. 2,989,798, Bannerman, is also involved in the production of a sheath core fiber in which both layers are polyamides. The core polyamide is chosen or modified to be more dye receptive. U.S. Pat. No. 2,063,180, Meyer, involves a coextrusion process in which an inner stream consisting of a volatile solvent carrying a coloring substance passes through a wick and is subsequently covered by a viscose solution. During spinning the volatile solvent diffuses through the forming rayon leaving behind only the coloring substance. The inner core would not exist as a discrete region since the dye would form a gradient into the rayon.

Other prior art references in this area, which are known to applicant, are set forth in the attached Information Disclosure Statement.

SUMMARY OF THE INVENTION

The invention involves creation of a sheath core fiber comprising an inner continuous core of an oriented thermoplastic material, such as nylon, polyester, acrylic, and olefin, and any other oriented thermoplastic material, completely surrounded by an adherent continuous sheath which is not readily removable from said core, is retained on said core during ultimate usage of said fiber, and is made of a nonthermoplastic material, such as rayon, or regenerated protein and any other appropriate nonthermoplastic material.

Also set forth is a method of making such a fiber wherein the core fiber is drawn through the liquid sheath-forming material and thence through a die. Because the core fiber is already oriented and in solid form, there is a very low tensile load on the sheath material and thus it will not develop significant crystal orientation during the drawing process, as would be the case if it alone were being drawn from the die. This results in the production of a sheath material which is not oriented and, consequently, has increased sorptivity and dyeability. Yet, because the core material constitutes the major cross section of the fiber, it will maintain the strength and crease and tear resistance which are characteristic of the core material. In producing this fiber, because of the tensile strength of the existing inner core structure, it is not necessary to coagulate the sheath material immediately as it exits from the die. Thus the die face does not have to be in contact with the acid bath as is the case of a viscose fiber being drawn from a die. This lessens the necessity of having the die face constructed of precious metal and significantly simplifies and reduces the cost of manufacturing the product.

It is therefore an object of this invention to provide a sheath core fiber combining the most desirable characteristics of the core, coupled with the most desirable characteristics of the sheath.

It is also an object of this invention to provide a method of making such a product.

These, together with other objects and advantages of the invention, will become apparent from the following detailed description of the invention.

DETAILED DESCRIPTION OF THE INVENTION

Figure 1:
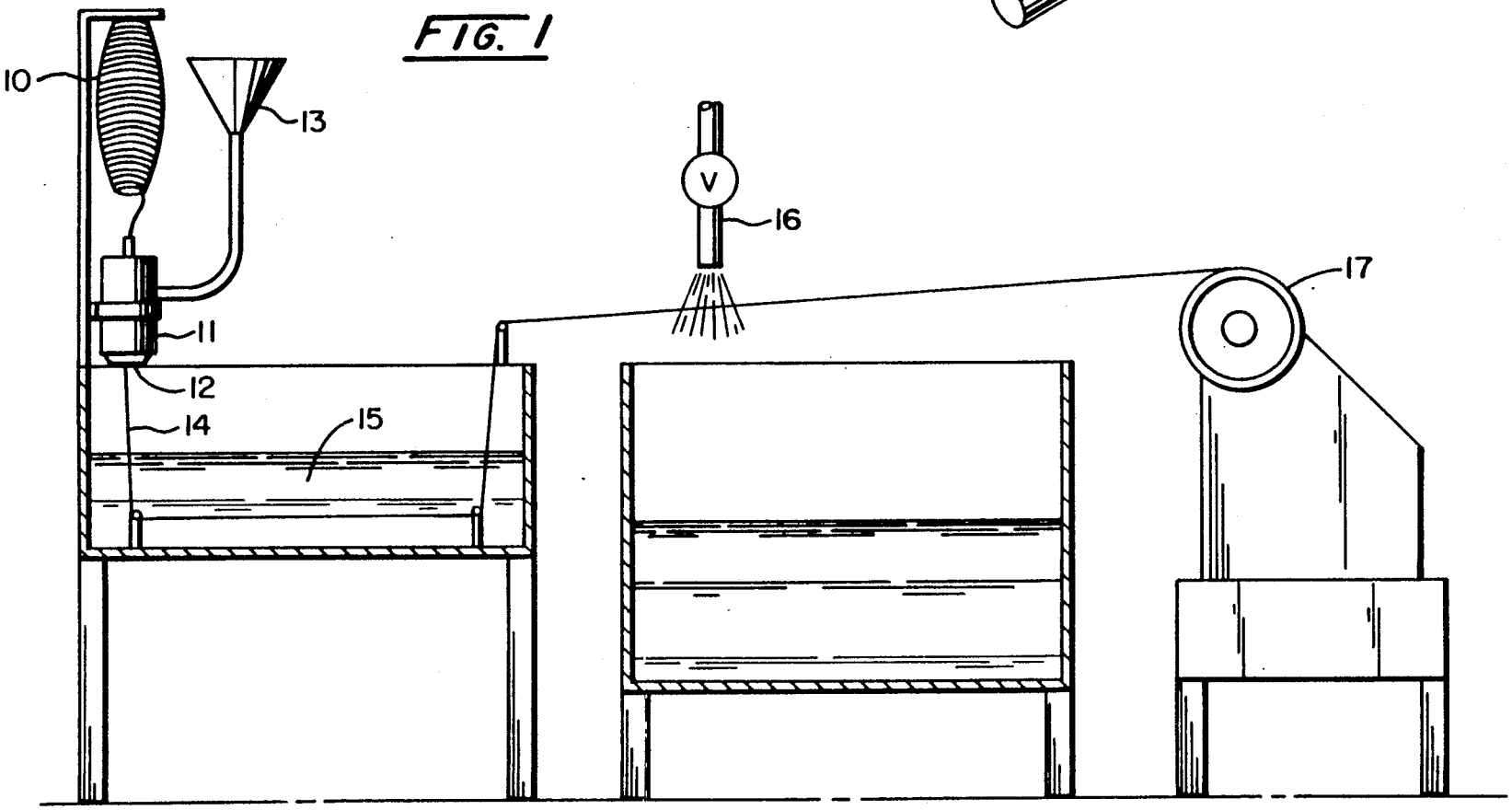
FIG. 1 is a schematic diagram of the method of producing the fiber of this invention.

Referring now to the drawings, and particularly to FIG. 1, in the method of making the fiber of this invention, the core material 10 is introduced into the chamber 11, which is provided with a die 12 at its lower end. The liquid sheath-forming material is introduced through member 13 by gravity or pressure flow into the chamber 11. The fiber solution contact region is designed to be sufficient to insure that the core 10 is thoroughly coated with the sheath-forming material prior to entering the die 12. The relative amount of solution coated onto the core fiber is controlled by die opening geometry, solution rheological properties, and drag and pressure driven flow. The combined sheath core fiber 14 exits the die 12 and enters the acid bath 15 where the sheath material is coagulated. The sheath core fiber 14 exits the acid bath 15, is rinsed with a water rinse 16, and is then collected on take-up roll 17.

Figure 2:
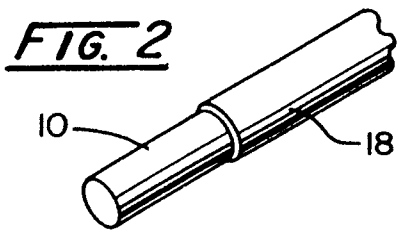
FIG. 2 is a perspective view of a single fiber.

Referring now more particularly to FIG. 2, the core material 10 is shown with the adherent continuous sheath material 18 completely surrounding the core material. Satisfactory fibers where the core 10 is 20 microns in diameter and the sheath material 18 is one micron in thickness have been produced. Thicker sheath layers have also been produced by increasing the pressure imposed in member 13.

Figure 3:
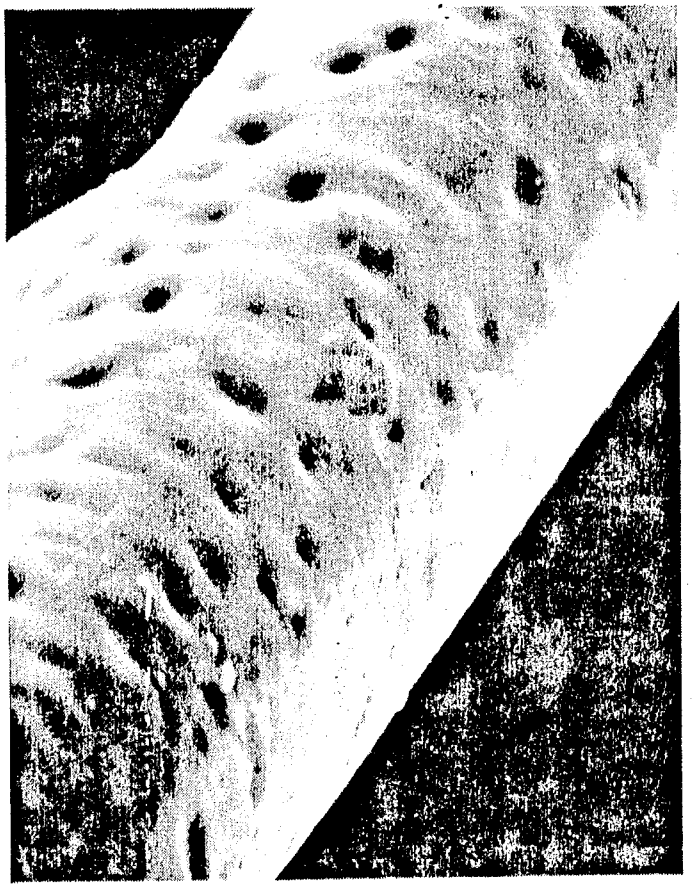
FIG. 3 is a scanning electron micrograph of a fiber produced by this invention at a magnification of 1250×.

FIG. 3, which is a scanning electron micrograph of the sheath core fiber shown in FIG. 2 at a magnification of 1250×, reveals dimples in the continuous sheath material 18 that are not elongated indicating lack of orientation of the surface and the enhanced surface area. Both of these properties contribute high sorptivity and thus comfort and dyeability. The method of producing such a fiber is described in detail in the following example which involves nylon 66 for the core and viscose rayon for the sheath. While the invention is described with respect to these two materials, and this is a preferred combination, it must be kept in mind that other core materials and other sheath materials are contemplated within the scope of this invention.

EXAMPLE 1

An already oriented nylon fiber was passed through a commercial viscose rayon solution and then drawn through a die. The core fiber was nylon 66 and was 20 microns in diameter. The die opening was approximately 800 microns and the resultant rayon skin thickness was one micron. The line speed of 100 feet per minute was used with a commercial concentration spinning bath consisting of nine weight percent sulfuric acid and 13 weight percent of sodium sulfate. Much higher line speeds, of course, can be used and different die openings and/or a higher pressure head may also be used. The resulting fibers maintain essentially the bulk mechanical properties of the nylon core and have the dyeability of rayon.

Commercial rayon fibers typically are formed from a solution containing about seven percent cellulose in a sodium xanthate form and seven percent alkali. An acceptable viscosity for spinning is achieved by ripening the viscose solution for four to five days. The fibers are formed by extruding thin filaments of this solution from a spinning bath in which the cellulose is regenerated from its xanthate form and coagulated. This is performed under tension and orientation develops in the rayon fiber, the level of which is controlled by the tension, cellulose source and character, and the spinning bath concentration and temperature.

In the instant invention, since the core material carries the tensile load, the sheath material develops very low, if any, orientation, as opposed to normal rayon fibers that are spun under tension to develop strength relating to orientation. This enables surface dimpling which results in an enhanced surface area contributing to higher sorptivity and greater dyeability. Furthermore, since the core material carries the tensile load, the acid bath, as shown in FIG. 1, can be spaced from the face of the die and thus precious metal faced dies are not needed in practicing this invention. In addition, since this process does not require the viscose solution to be able to be drawn into a fiber, a broader class of viscose solutions may be used.

While the core material 10 has been shown as a single monofilament, it should be kept in mind that, contemplated within the scope of this invention are multiple filament bundles, such as yarns, which may also be used as core material.

While this invention has been described in its preferred embodiment, it is appreciated that slight variations may be made without departing from the true scope and spirit of the invention.

We claim:

1. A sheath core fiber comprising an inner continuous core of an oriented thermoplastic material completely surrounded by a continuous adherent organic polymeric sheath which is formed from a polymer sheath forming material in liquid form, is not readily removable from said core, is retained on said core during ultimate usage of said fiber, and is made of a nonthermoplastic material, said sheath having minimal orientation and characterized by microscopic surface dimpling resulting in an enhanced surface area for higher sorptivity and greater dyeability.

2. The article of claim 1 wherein the inner core is made of a material selected from the group consisting of polyesters, nylons, acrylics, and olefins.

3. The article of claim 1 wherein the sheath is made of a material selected from the group consisting of regenerated cellulose and regenerated protein.

4. The article of claim 2 wherein the sheath is made of a material selected from the group consisting of regenerated cellulose and regenerated protein.

5. A sheath core fiber comprising an inner continuous core of an oriented thermoplastic material selected from the group consisting of nylons, polyesters, polyacrylics, and polyolefins, completely surrounded by a continuous adherent organic polymeric sheath comprising a material selected from the group consisting of regenerated cellulose, and regenerated protein, which is formed from a polymer sheath forming material in liquid form, is not readily removable from said core, and is retained on said core during ultimate usage of said fiber, said sheath having minimal orientation and characterized by microscopic surface dimpling resulting in an enhanced surface area for higher sorptivity and greater dyeability.

* * * * *